US005447336A

United States Patent [19]

Deighton

[11] Patent Number: 5,447,336

[45] Date of Patent: Sep. 5, 1995

[54] ROAD PAVEMENT MANAGEMENT INSTRUMENT

[75] Inventor: Richard A. Deighton, Bowmanville, Canada

[73] Assignee: Deighton Associates Limited, Ontario, Canada

[21] Appl. No.: 295,930

[22] Filed: Aug. 25, 1994

[51] Int. Cl.[6] ..... B42D 15/00

[52] U.S. Cl. ..... 283/115; 402/79

[58] Field of Search ..... 281/38, 2; 283/115, 283/44, 48.1, 55; 402/79

[56] References Cited

U.S. PATENT DOCUMENTS

| | | | |
|---|---|---|---|
| 916,047 | 3/1909 | Smith | 402/79 X |
| 5,263,744 | 11/1993 | Lindens | 283/115 |
| 5,299,879 | 4/1994 | Burrow | 402/79 |
| 5,333,908 | 8/1994 | Dorney et al. | 402/79 X |

*Primary Examiner*—Willmon Fridie

*Attorney, Agent, or Firm*—Volpe and Koenig

[57] ABSTRACT

A set of forms for management of road conditions is provided consisting of a road inventory form and a construction form, said road inventory form comprising: (a) a locational features section having a vertical column divided into boxes by a series of horizontal lines, in each of which boxes a location may be written; and (b) a pavement condition section having a vertical column divided into boxes by a series of horizontal lines, in each of which boxes the pavement condition at the location may be written; said construction form comprising a pavement treatment section having a vertical column divided into boxes by a series of horizontal lines, in each of which boxes a type of pavement treatment may be written; the arrangement being such that the construction form may be aligned with the road inventory form so that a type of pavement treatment may be entered in the pavement treatment section for the pavement condition at the given location.

12 Claims, 6 Drawing Sheets

ROAD PAVEMENT MANAGEMENT INSTRUMENT

BACKGROUND OF THE INVENTION

The invention herein relates to a pavement management system for roads, and more particularly to a set of sheets for multi-year programme planning, priority setting, and report creation compiled into a log book, or what will be referred to hereafter as a road log.

A log of road conditions is an essential tool for road managers in planning for construction to be completed on various segments of road within a road network and setting priorities for construction on a basis of cost verses need. In addition to the road surface per se, road managers are often responsible for the maintenance and repair of point objects (signs, culverts, bridges, etc.) along the roadside. Accordingly, detailed information of the point object's condition of repair, repair history, etc. may also be required for setting priorities.

Today road management is widely handled using computer tools, however, road managers are often reluctant to bring notebook computers into the field and there is often duplication of effort in first gathering data and then entering it into a computer back at the office. Furthermore, computers lack the "hands-on" feel and accessibility that a road log provides. The invention herein is a completely modular and generic log that can be customized for any number of road segments and can easily carried with the road manager on his travels over a road network.

It is thus an object of the present invention to provide an easy to compile, readable and comprehensive pavement management system for a road network which comprises in a road log a set of each of the following forms: (i) a road inventory form for an inventory of road conditions for a particular segment of road; and (ii) a utility form for planning various construction projects for segments of that road.

It is a further object of the present invention to provide additional sets of forms for the road log for the compilation of information and statistics pertaining to point objects encountered along a particular segment of road.

It is still a further object of the present invention to provide a set of programming and budgeting forms for the road log for various road construction projects along segments of a road within a road network.

SUMMARY OF THE INVENTION

According to the invention there is provided a set of forms for management of road pavement conditions consisting of a road inventory form and a construction form, said road inventory form comprising:

(a) a locational features section having a vertical column divided into boxes by a series of horizontal lines, in each of which boxes a road location may be written; and (b) a pavement condition section having a vertical column divided into boxes by a series of horizontal lines, in each of which boxes the pavement condition at the location may be written; and said construction form comprising a pavement treatment section having a vertical column divided into boxes by a series of horizontal lines, in each of which boxes a type of pavement treatment may be written; means to arrange the boxes of the construction form so that they are aligned with those of the road inventory form so that a type of pavement treatment may be entered in a box of the pavement treatment section and correlated with boxes corresponding to the pavement condition at the given road location.

There is still further provided a set of forms wherein the road inventory form has a cross reference code section having a vertical column divided into boxes by a series of horizontal lines. In each of the boxes a code for a particular point object may be written; and a point object description form comprising:

a) a code section having a vertical column divided into boxes by a series of horizontal lines, in each of which boxes the point object code from the road inventory form may be written;

b) a description section having a vertical column divided into boxes by a series of horizontal lines, in each of which boxes a description of the particular point object may be written; and c) an attribute section having a plurality of vertical columns divided into boxes by a series of horizontal lines, in each of which boxes an entry of one or more attributes of a particular point object may be written.

There is also provided a set of forms for management of road pavement conditions. The forms consist of a program planning form and a priority guide form. The program planning form comprises:

(a) a locational features section having a vertical column divided into boxes by a series of horizontal lines, in each of which boxes a locational feature may be written; and (b) a planning column having a vertical column divided into boxes by a series of horizontal lines, in each of which boxes a type of treatment and cost of treatment may be written; the arrangement being such that a locational feature from the road inventory form may be written onto the program planning form together with tile type of treatment required and cost of that treatment, the cost of that treatment may then be totalled for a construction program plan.

The priority guide form comprises:

(a) a priority calculation section having a set of vertical columns divided into boxes by a series of horizontal lines, in each of which boxes the priority of an attribute may be indicated by proportional shading; and (b) means to arrange the boxes of the priority guide form so that they are aligned with those of the program planning form so that each attribute may be indicated by proportional shading in the boxes of the priority calculation section and correlated with boxes corresponding to the treatment and cost for a given location.

BRIEF DESCRIPTION OF THE DRAWINGS

These and other objects and advantages of the invention will become apparent upon reading the following detailed description and upon referring to the drawings in which.

DETAILED DESCRIPTION OF THE PREFERRED EMBODIMENTS

Figure 1:
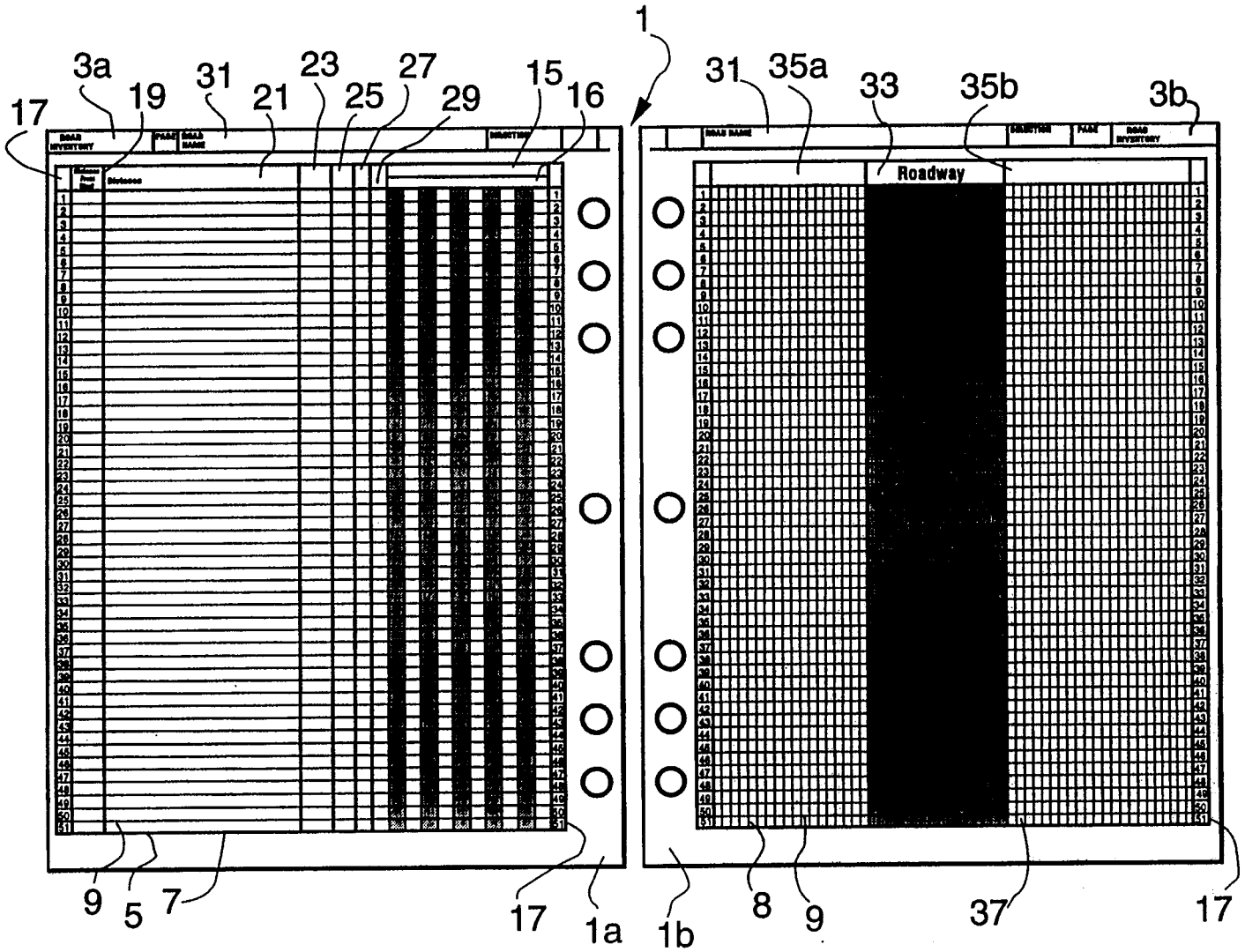
FIG. 1 illustrates a plan view of each side of the road inventory sheet according to the invention.

In the drawings, similar features have been given similar reference numerals.

Turning to FIG. 1 there is shown a road inventory sheet 1 having left form 3*a* and right form 3*b* printed on each side 1*a* and 1*b* thereof. The left "road inventory" form 3*a* of the road inventory sheet 1 tabulates information for a particular section of road and is divided generally into a series of columns 5 which are in turn divided into boxes 7 by a series of horizontal lines 9. The form 3*a* is generally divided into columns for recording locational features encountered along the particular section of road (signs, bridges, etc.), attributes of the road section in particular (width, pavement type, etc.) and pavement condition history of the road section. More particularly, reading from left to right there is a "reference numeral" column 17, "distance from start" column 19, "description" column 21, "cross reference code" column 23, "width" column 25, "pavement type" column 27, "traffic level" column 29, and "pavement condition history" column 15 (divided into sub-columns 16 entitled "year" for a ten year period). A title heading 31 is also provided on the top of the form for information such as page number, road name and direction of travel (e.g. north, south, etc.). The right "road inventory" form 3*b* of the road inventory sheet 1 is divided into a central vertical road surface, or "roadway" column 33, representing a plan view of the road surface, and adjacent vertical columns 35*a* and 35*b* representing a plan view of the left and right roadway areas immediately adjacent the road surface. Each of columns 33, 35*a* and *b* of right road inventory form 3*b* are divided into spaces 8 by a series of horizontal lines 9 and vertical lines 37 to provide a graph paper format. A title heading 31 and reference numeral column 17 are again provided.

Figure 2:
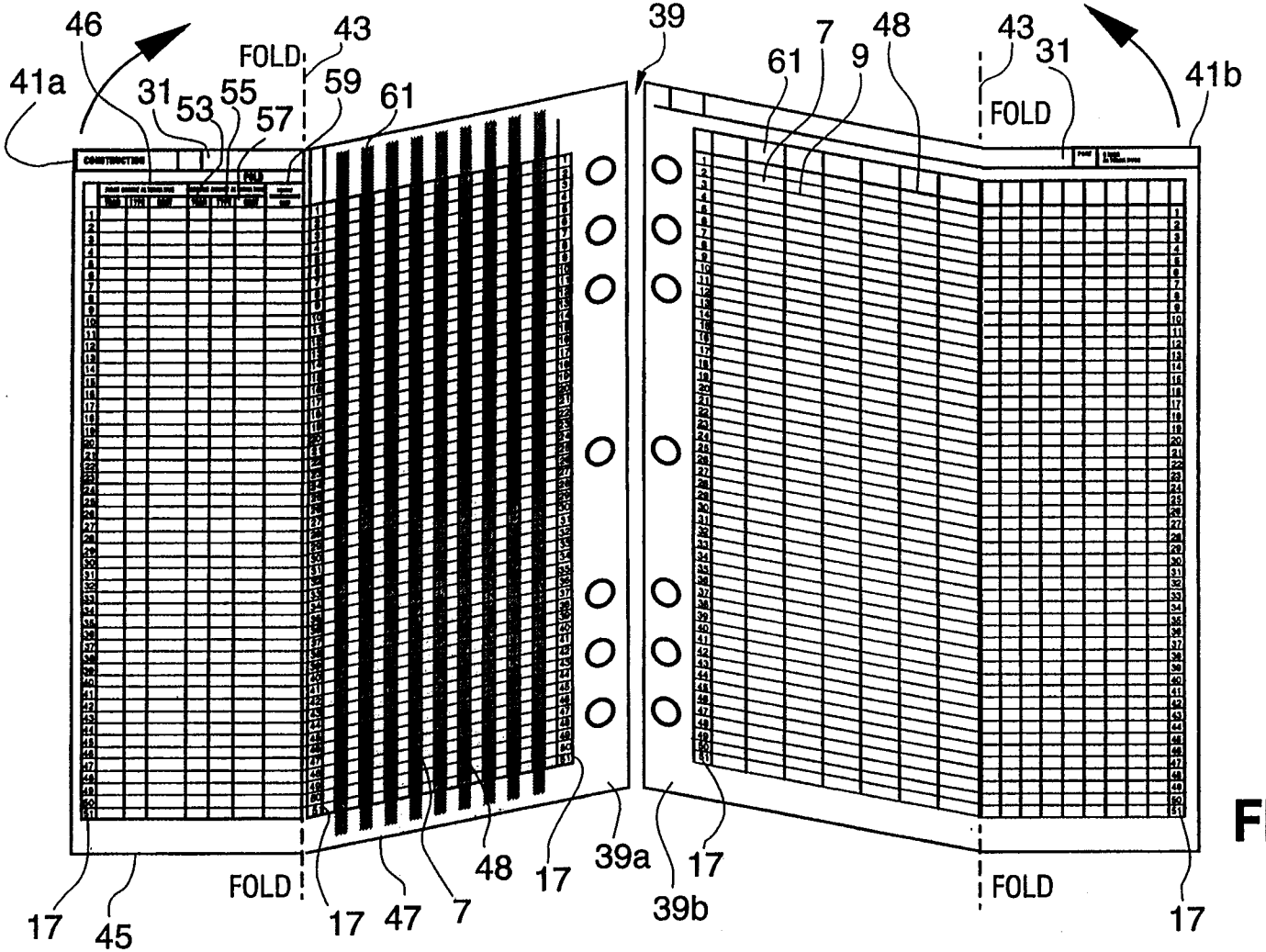
FIG. 2 illustrates a plan view of each side of the utility sheet according to the invention.

In FIG. 2 there is shown a utility sheet 39 having left form 41*a* and right form 41*b* printed on each side 39*a* and 39*b* thereof. The left form 41*a* of the utility sheet 39 is a "construction" form and the right form 41*b* is an "other attributes" form. The utility sheet 39 can be folded down a center line 43 so that it can be read in association with information on adjacent sheets in an assembled log book of sheets. The construction form 41*a* is divided generally into a first area 45, a pavement treatment section, and a second area 47 by the fold line 43. First area 45 has a reference numeral column 17, first and second "construction alternative" columns 46 (divided into sub-columns entitled "year" 53, "type" 55, and "cost" 57) and an "actual yearly maintenance cost" column 59. Second area 47 consists of a reference numeral column 17 and a series of non-specific columns 61 which are in turn divided into boxes 7 by a series of horizontal lines 9 and vertical lines 48. The "other attributes" form 41*b* can again be folded down a center line 43 and is divided generally into a series of non-specific columns 61 which are in turn divided into boxes 7 by a series of horizontal lines 9 and vertical lines 48. A title space 31 is provided on the top of each form for information such as the page number and reference numeral column 17 are again provided.

Figure 3:
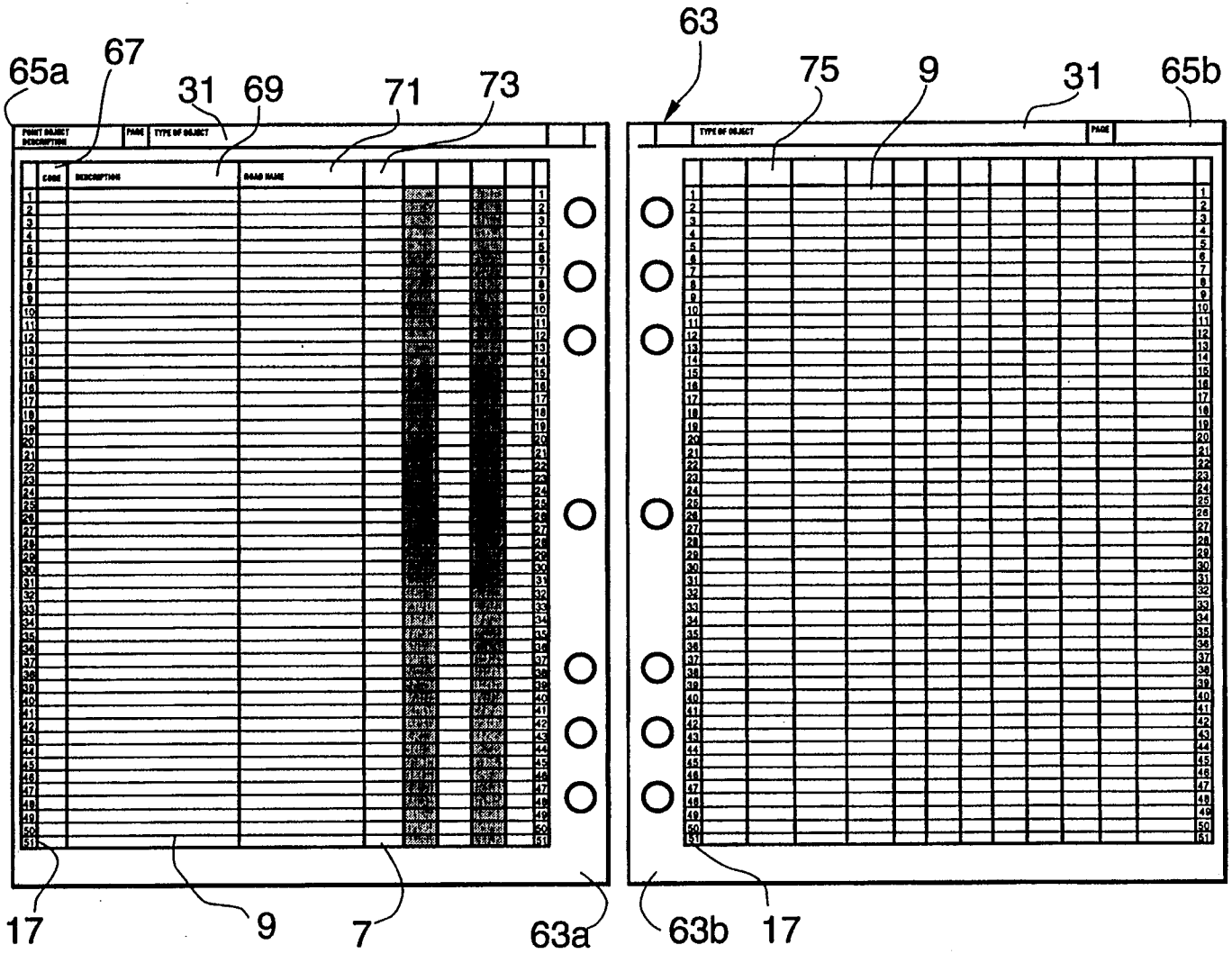
FIG. 3 illustrates a plan view of each side of the point object sheet according to the invention.

In FIG. 3 there is shown a point object sheet 63 having left form 65*a* and right form 65*b* printed on each side 63*a* and 63*b* thereof. The left form 65*a* of the point object sheet 63 is a "point object description" form and the right form 65*b* is a "point object" form. The point object description form 65*a* has a reference numeral column 17, a "code" column 67, a "description" column 69, a "road name" column 71, and a series of non-specific columns 73, all of which are divided into boxes 7 by a series of horizontal lines 9. The "point object" form consists of a reference numeral column 17 and a series of non-specific columns 75 which are in turn divided into a boxes 7 by a series of horizontal lines 9. A title space 31 is provided on the top of each form for information such as page number and type of object.

Figure 4:
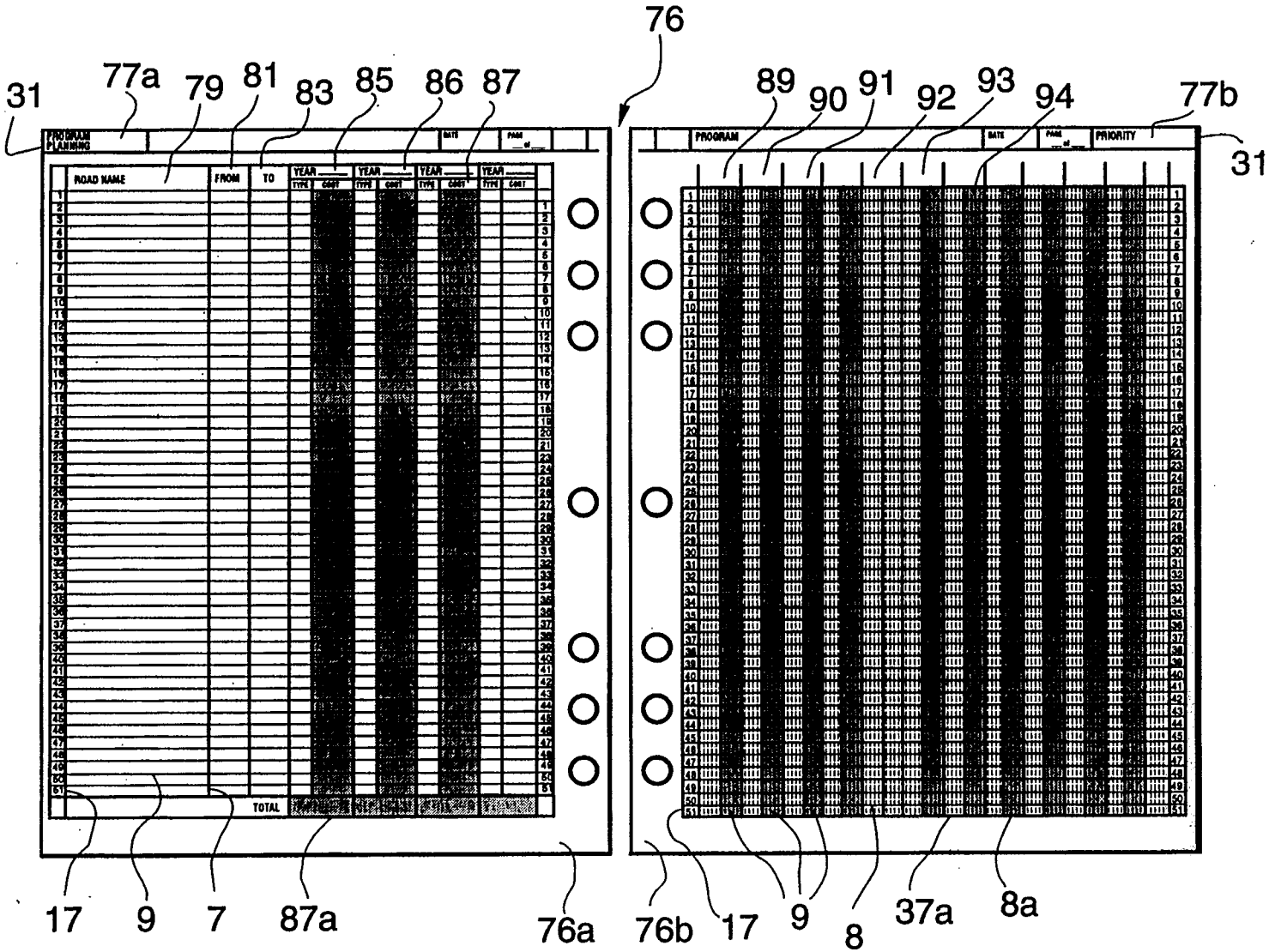
FIG. 4 illustrates a plan view of each side of the programming and budgeting sheet according to the invention.

In FIG. 4 there is shown a programme and budgeting sheet 76 having left form 77*a* and right form 77*b* printed on each side 76*a* and 76*b* thereof. The left form 77*a* of the programme budgeting sheet 76 is a "programme planning" form, or construction program plan, and the right form 77*b* is a "priority guide" form. The programme planning form has a reference numeral column 17, a "road name" column 79, a "from" column 81, a "to" column 83 and a series of "year" columns 85 with sub-columns "type" 86 and "cost" 87. Each column is divided into boxes 7 by a series of horizontal lines 9. The "cost" sub-columns 87 have "total" boxes 87*a* at the bottom of each sub-column. The "priority guide" form consists of a reference numeral column 17, a "ride" column 89, a "cracking" column 90, a "maintenance cost" column 91, a "traffic level" column 92, an "importance" column 93, and a series of non-specific columns 94. Each column of right form 77*b* is divided into two spaces 8 by a series of horizontal lines 9. Each space 8 is then subdivided by four vertical lines 37*a* to create five sub-spaces 8*a* in each space 8. A title space 31 is provided on the top of each form for information such as page number, date, etc.

Figure 5:
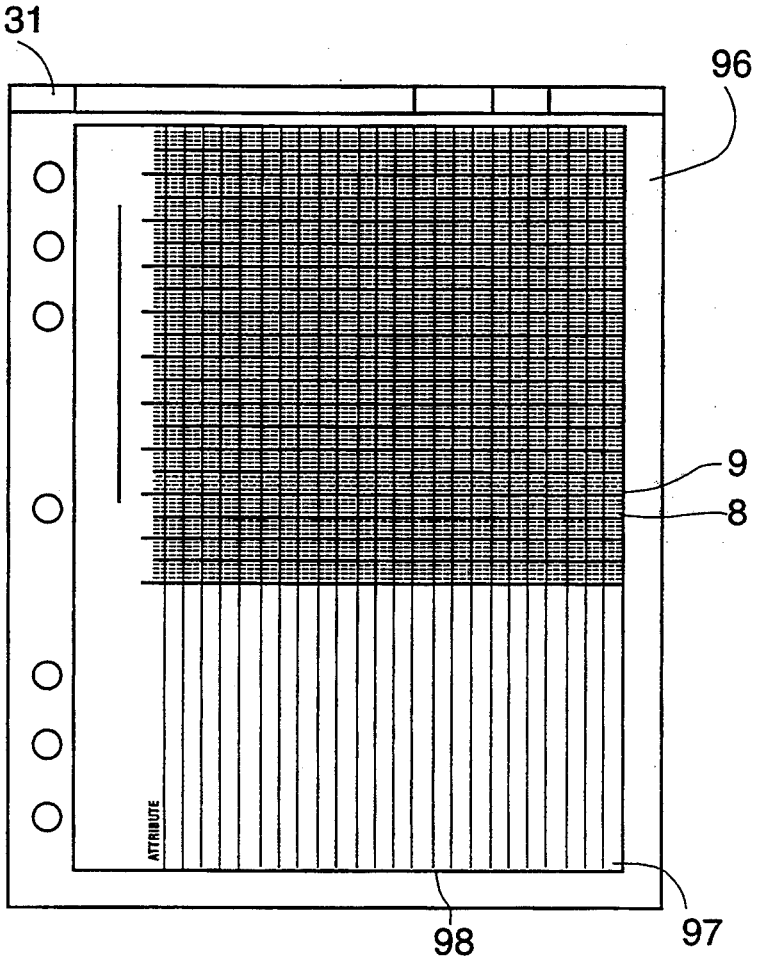
FIG. 5 illustrates a plan view of a bar chart sheet according to the invention.

In FIG. 5 there is shown a bar chart sheet 95 with a bar chart form 96 printed on each side. The bar chart form 96 has a series of non-specific columns 97 which are in turn divided into spaces 8 by a series of horizontal lines 9. At the base of each column 97 there is a heading area 98 entitled "attributes". A title space 31 is provided on the top of each form for information such as page number, date, etc.

Figure 7:
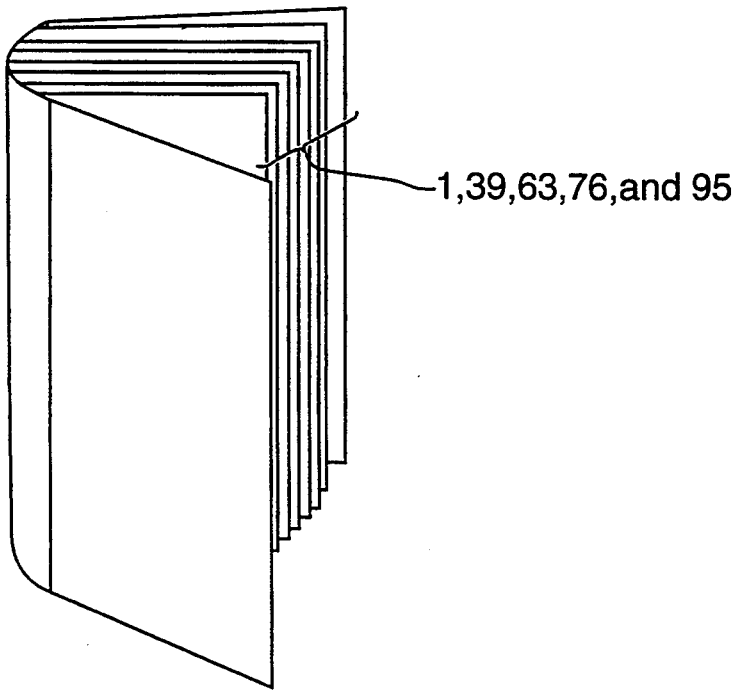
FIG. 7 illustrates a closed road log binder containing a plurality of sheets in accordance with the invention.
Figure 6:
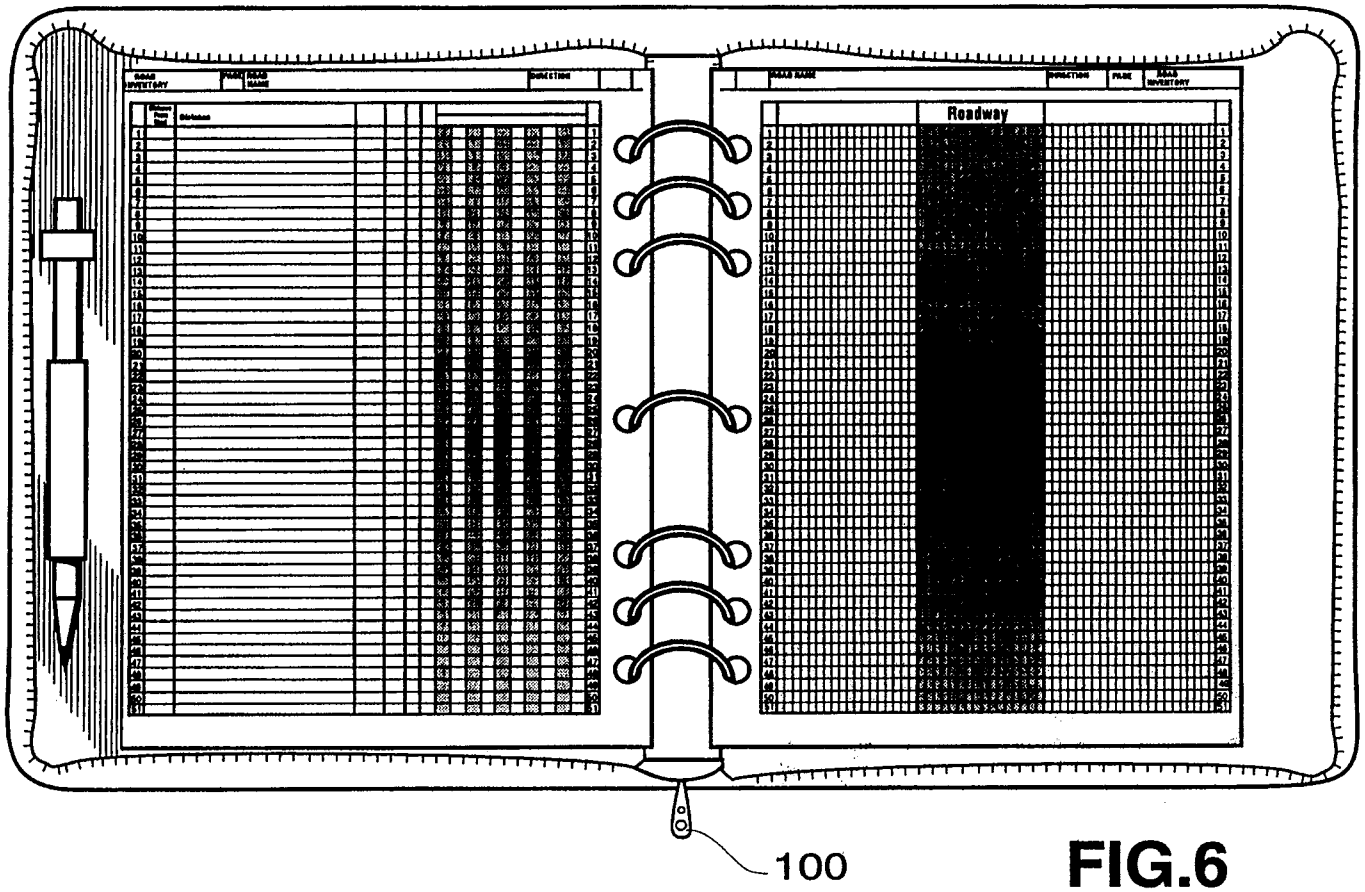
FIG. 6 illustrates a plan view of a road log binder containing a plurality of sheets in accordance with the invention.

The road log sheets are assembled and kept in a binder as shown in FIGS. 6 and 7.

The sheets 1, 39, 63, 76, and 95 as described above are assembled into a log book 100 where information pertaining to road features, as will be described more fully below, can be entered on to them. In this way vital statistics concerning a particular road section in a network are generated. There is no particular order of the sheets required, however, where information from one form is to be cross-referenced to another (e.g. from the construction form 41*a* to the road inventory form 3*a*) they may be placed one after another in an alternate arrangement, such that when the book is opened form 3*a* is on the left side and form 41*b* of sheet 39 is on the right side. Sheet 39 may then be folded along line 43 (as seen in FIG. 2) and placed over form 3*a* such that the first 45 or second 47 areas can be aligned with columns 17, 19, and 21.

There are three steps involved in setting up the road log: (i) a location and reference survey of a section of road; (ii) an inventory and condition survey; and (iii) a survey of point objects.

The first step in using the road log is to generate an inventory of road conditions, or fixed data, using the left road inventory form 3*a*. A given section of road is surveyed by travelling, for example, from points A to B. Prior to commencing, the name of the road segment for which the data is being collected would be entered on the form in heading 31 and also the direction of travel. To collect the road location reference information the road manager starts at the beginning of the road segment to be surveyed (point A) and sets the odometer of his vehicle to zero ready for the drive to the end of the road survey section (point B). Each time a notable feature (e.g. pavement type change, intersection, bridge, guardrails etc.) is passed the odometer distance is entered in column 19 and a brief description of the feature entered in column 21. At reference numeral 1 (column 17) the starting distance would be 0 km (entered in column 19) for point A (entered in column 21, e.g. Smith Road). As the survey section of the road is travelled, the following entries could be made:

(i) Column 21, enter a descriptive visual feature using abbreviations such as "JCT" for junction, "PVT CHNG" for pavement change.

(ii) Column 23 fill in a code number for the feature if a point object inventory is going to be compiled for those features (this code must be unique for each particular point object of a given feature type).

(iii) Column 25 fill in the width of the road when a change is noted.

(iv) Column 27 fill in a code for the pavement type (such as "G"=gravel, "A"=asphalt, "C"=concrete, "S "=surface treatment).

(v) Column 29 fill in a code for traffic level (e.g. "S"=slight, "L"=low, "M"=moderate, "H"=heavy, "E"=extreme).

(vi) Column 16 fill in the condition of the pavement for the year of the survey (e.g. 0 (impassable) to 99 (good)).

The right road inventory sheet 3*b* can be used to generate a schematic plan view from the survey information gathered from the left sheet 3*a*. For example, if a pot hole were encountered at the distance from start corresponding to reference numeral 8 in column 17 of sheet 3*a*, this could be entered schematically on the roadway column 33 of sheet 3*b* at the corresponding reference numeral 8 (other road surface features such as cracks, pavement marking etc. can be entered). Point objects such as traffic signs, culverts etc. can be entered using symbols at the side of the roadway column in columns 35*a* and 35*b*.

The road inventory sheet can have a fixed scale (i.e each reference numeral in column 17 equals 10 meters) or a variable scale (e.g. successive features can be record without regard to scale providing a distance from start measurement is taken from the odometer and entered in column 19).

The utility sheet 39 can be placed in between road inventory sheets as previously discussed. Referring to the construction form 41*a* (FIG. 2) of the utility sheet 39, the left side 45 form 41*a*, or pavement treatment section, is for the recordal of information regarding types of pavement treatment: (a) alternatives available for fixing each section of road (i.e. patching "P", resurfacing "RS", nothing "N"), and (b) the current annual maintenance cost for the section of road. The right side of the form 47 is for a pictorial representation of the history of the road in profile, allowing the surveyor to show the type, thickness and year of each road layer. For example, if in 1987 the road section corresponding to reference numerals 1 to 8 in column 17 was gravel, the year 1987 is entered as a column 61 heading and boxes 7 corresponding to reference numerals 1 to 8 shaded accordingly. If in the next year the road section is surfaced, this information is added to the next available column 61, thus providing a historical profile of the road layers.

Referring to FIG. 3, the point object sheet is a table for data describing one particular group of similar point objects (e.g. bridges, culverts, signs, etc.) A different table can be set up for different groups of point objects or it can be set up for a particular set of objects along a road section. Cross reference codes are assigned in columns 23 on the left road inventory sheet 3*a* and then entered under the code in column 67 on the point object description form 65*a*. The columns 73 and 75 of the table on both the left 65*a* and right forms 65*b* are attribute columns where an entry of any particular attribute of an object which requires description can be made. For example, headings such as condition, date of last repair etcetera could be entered in the column headings and then the information entered for each object as is required in the columns.

The program planning form 77*a* allows the road manager to define a list of either sections of road and/or point objects (or locational features) which require work. If a section of road or a point object requires work, the road or point object is first identified as a locational feature in column 79, then if it is a road the "From" 81 and "To" 83 columns are completed using an odometer reading to identify the section. In one of the four planning columns 85, the type 86 of pavement treatment or repair (such as patching "P", resurfacing "RS", nothing "N") and cost 87 of a particular project can be defined. The total cost of the projects is then entered at the bottom of the column 87*a* for the given year. If for some reason the total cost at the bottom of column 87*a* exceeds the budget for the respective year, then the priority form 77*b* can be used to calculate the relative priority for each road section on the programming and budgeting form. The priority guide form 77*b* consists of eleven columns, each being a priority calculation section representing a different attribute involved in setting construction program priorities. The first five columns 89 to 93 have already been assigned attribute headings (e.g. "roughness", "cracking", etc.). A subjective decision is made by the road manager in respect of each attribute and a proportionate amount of space 8 is filled in depending on the immediate necessity to complete the job. For example, for a severely cracked section of road all of the sub-spaces 8*a* of the two spaces 8 would be shaded in column 90, whereas if the asphalt surface were not cracked, none would be completed. Using this type of proportional shading, a visual picture of the priority of each element of the job is generated, the highest priority being given to the elements with the greatest amount of shading.

Finally, it is often important for a road manager to know how certain characteristics are distributed throughout his network, such as the length of gravel roads verses asphalt. Knowing the distribution of road conditions will provide him with information required to make decisions with respect to future construction requirements, maintenance etc. The bar chart form 96 shown in FIG. 5 allows for the plotting of these characteristics. Under the attribute heading (x axis) 98 a particular characteristic can be entered (such as asphalt surface, gravel surface, packed earth surface, etc.) and then the length of each section of the road within the network which has such characteristic can be entered using proportional shading along the y axis. In this way a visual picture of how the characteristics are distributed within the network is created.

From the above it is apparent that there has been provided a pavement management instrument that fully satisfies the objects, aims and advantages set forth above. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A system for management of road pavement conditions consisting of a road inventory form and a construction form, said road inventory form comprising:

(a) a locational features section having a first vertical array of boxes in which a road location may be written; and (b) a pavement condition section having a second vertical array of boxes in which the pavement condition at the respective location of the first array may be written; and said construction form comprising a pavement treatment section having a third vertical array of boxes in which a type of pavement treatment may be written wherein the boxes of the construction form are aligned with those of the road inventory form so that a type of pavement treatment may be entered in a box of the pavement treatment section and correlated with the first and second arrays of boxes corresponding to the pavement condition at the given road location.

2. A system according to claim 1 wherein the array of the pavement treatment section is sub-divided into two columns for first and second alternative types of pavement treatment.

3. A system according to claim 2 wherein the first and second alternative type of treatment columns are each sub-divided into columns for year of treatment, type of treatment and cost of treatment.

4. A system according to claim 1 wherein the location features section is sub-divided into sub-columns for entry of information pertaining to distance travelled from a fixed point, a visual descriptive feature, width of pavement, type of pavement and traffic level.

5. A system according to claim 1 wherein the pavement condition section is sub-divided into two or more columns for the entry of pavement conditions in two or more specified years.

6. A system according to claim 1 wherein the road inventory form has on its reverse side a form having a central roadway column and left and right road area columns divided into spaces by horizontal lines.

7. A system according to claim 1 wherein the construction form has a plurality of information boxes corresponding to the pavement treatment section.

8. A system according to claim 1 wherein the road inventory form has a cross reference code section having a fourth vertical array of boxes in which a code for a particular point object may be written and a point object description form comprising:

(a) a code section having a sixth vertical array of boxes in which the point object code from the road inventory form may be written;

(b) a description section having a seventh vertical array of boxes in which a description of the particular point object may be written; and (c) an attribute section having at least an eigth vertical array of boxes in which an entry of one or more attributes of a particular point object may be written.

9. An arranged set of forms for management of road pavement conditions comprising a road inventory form for entering locational features, a program planning form and a priority guide form, said program planning form comprising:

(a) a locational features section having a vertical column divided into boxes by a series of horizontal lines, in each of which boxes information relating to features at a road location may be written; and (b) a planning column having a vertical column divided into boxes by a series of horizontal lines, in each of which boxes information regarding a type of treatment and cost of treatment may be written; the forms being aligned to facilitate writing a locational feature from the road inventory form onto the program planning form together with the information regarding the type of treatment required and a cost of that treatment, wherein the cost of all treatments may then be totalled to provide information for a construction program plan;

said priority guide form comprising a priority calculation section having a set of vertical columns divided into boxes by a series of horizontal lines such that the priority of an attribute may be indicated by shading a proportional amount of boxes based on the immediate necessity of treating each attribute; and the boxes of the priority guide form being alignable with the boxes of the program planning form so that proportional shading in the boxes of the priority calculation section can be correlated with information regarding the treatment and the treatment cost for a given location to allow a user of the forms to determine the order in which attributes are treated.

10. A method for managing road pavement comprising:

(a) traveling from a first location along a roadway to at least a second location (b) making an inventory of roadway features in a road inventory form comprising at least one vertical column divided into boxes by a series of vertical lines by recording the roadway features in a box with information concerning the features and the relative location of the features with respect to said first location;

(c) documenting information regarding roadway pavement condition on a pavement condition form comprising at least one vertical column divided into boxes by a series of vertical lines, by recording the pavement conditions in a box with the relative location of the pavement condition with respect to said first location;

(d) documenting information regarding proposed treatment for the pavement surface in a construction form comprising at least one vertical column divided into boxes by a series of vertical lines by recording the proposed treatment in a box with information concerning the costs associated with the treatment and the relative location of the proposed treatment with respect to said first location; and (e) aligning the inventory form, pavement condition form, and pavement treatment form to facilitate comparison of information regarding roadway features, pavement conditions and proposed treatments for points at the same relative location.

11. The method of claim 10 further comprising:

(a) summing the amount of treatment costs entered in the pavement treatment form;

(b) entering the sums so derived on a program planning form comprising at least one vertical column divided into boxes by a series of vertical lines;

(c) recording on a priority guide comprising at least one vertical column divided into boxes by a series of vertical lines, information, in the form of proportionally shaded boxes, regarding the necessity of proposed treatments at locations relative to said first location;

(d) aligning the program planning form, road inventory form and priority guide to facilitate comparison of the information regarding treatment costs and necessity to prioritize the order in which the proposed treatments will be performed;

(e) assigning priorities to the proposed treatments based on a comparison of the program planning form and the road invention form; and (f) recording the priorities on the priority guide.

12. An arranged set of forms for management of road pavement conditions comprising:

a road inventory form and a construction form; said road inventory form including:

(a) a locational features section having a vertical column divided into boxes by a series of horizontal lines such that information relating to features at a road location may be written in each of the boxes; and (b) a pavement condition section having a vertical column divided into boxes by a series of horizontal lines such that information relating to the pavement condition at a road location may be written in each of the boxes;

said construction form including a pavement treatment section having a vertical column divided into boxes by a series of horizontal lines such that information relating to a type of pavement treatment may be written in each of the boxes; and the boxes of the construction form are aligned with the boxes of the road inventory form such that a user of the forms can generate statistics concerning a road section by entering a type of pavement treatment in the boxes of the pavement treatment section and correlating such entries with entries in boxes corresponding to the pavement condition for the same road locations.

* * * * *